United States Patent [19]

Ohba et al.

[11] Patent Number: 4,976,743

[45] Date of Patent: Dec. 11, 1990

[54] DYEING AUXILIARY COMPOSITION: LEVELLING AGENT FOR REACTIVE DYES CONTAINING HYDROXY SULFONIC ACID ANIONIC SURFACTANT AND POLY-BASIC POLYMER

[75] Inventors: Noriaki Ohba; Yujin Tabata, both of Tokyo; Masaaki Nagatsuka, Saitama; Tateyuki Nagatomi, Tokyo; Helmut Klicker, Hyogo, all of Japan

[73] Assignee: Nihon Surfactant Kogyo K.K., Tokyo, Japan

[21] Appl. No.: 331,902

[22] Filed: Mar. 31, 1989

[30] Foreign Application Priority Data

Jul. 4, 1988 [JP] Japan ..... 63-166385

[51] Int. Cl.[5] ..... D06P 1/62; D06P 3/00; C09B 67/00

[52] U.S. Cl. ..... 8/543; 8/557; 8/558; 8/559; 8/589; 8/591; 8/917; 8/918

[58] Field of Search ..... 8/543, 557, 558, 559, 8/589, 591

[56] References Cited

U.S. PATENT DOCUMENTS

| | | | |
|---|---|---|---|
| 4,137,251 | 1/1979 | Berger | 8/925 |
| 4,444,563 | 4/1984 | Abel | 8/588 |
| 4,444,564 | 4/1984 | Salathe et al. | 8/588 |
| 4,563,192 | 1/1986 | Salathe et al. | 8/554 |

*Primary Examiner*—A. Lionel Clingman

*Attorney, Agent, or Firm*—Flynn, Thiel, Boutell & Tanis

[57] ABSTRACT

Fiber articles are uniformly dyed with use of a dyeing auxiliary composition which comprises an anionic surfactant of the alpha-hydroxysulfonic acid type and an organic polybasic polymer and has a pH of 9 or higher.

8 Claims, No Drawings

DYEING AUXILIARY COMPOSITION: LEVELLING AGENT FOR REACTIVE DYES CONTAINING HYDROXY SULFONIC ACID ANIONIC SURFACTANT AND POLY-BASIC POLYMER

The present invention relates to a leveling agent composition for reactive dyes. In particular, the present invention relates to a dyeing auxiliary composition capable of simplifying the dyeing steps and making level dyeing possible in dyeing fibers with a reactive dye.

DESCRIPTION OF THE PRIOR ART

Natural fibers such as wool, hemp and cotton fibers are dyeable with a reactive dye.

As for the principle of dyeing with a reactive dye, the fibers are dyed by utilizing a chemical reaction between the fibers and the dye in addition to a physical bonding force between them, while dyeing with another kind of dye is conducted by utilizing the physical bonding force. Therefore, the following processes have heretofore been employed for conducting the level dyeing:

(1) addition of an inorganic salt in portions to a dyeing bath in order to control the physical bonding between the fibers and the dye, (2) addition of an alkali in portions to a dye bath in order to control the chemical reaction between the fibers and the dye, and (3) complicated control of the dye bath temperature.

However, in above-described processes (1) to (3), the dyeing conditions will vary according as the kind of dyeing machines or the combination of dyes is changed and, therefore, the conditions must be arranged suitably each time. As a result, the combination of dyes and the dyeing machine must be inevitably limited. This is a serious problem for dyers.

SUMMARY OF THE INVENTION

After intensive investigations made for the purpose of solving the above-described problems, the inventors have found a leveling agent with which level dyeing can be conducted with a reactive dye while the dye bath temperature is kept constant at a suitable temperature to attain an excellent repeatability without necessitating complicated operations such as the addition of an alkali or inorganic salt in portions. The present invention has been completed on the basis of this finding.

The present invention provides a leveling agent composition for reactive dyes characterized by comprising an anionic surfactant of an α-hydroxysulfonate type and a polymeric compound of an organic polybasic acid type and having a pH of 9 or higher.

The anionic surfactants of an o-hydroxysulfonate type usable in the present invention include compounds of following formulae (1) and (2):

$$R\text{-}(O\text{-}CH_2\text{-}\underset{\underset{OH}{|}}{CH}\text{-}CH_2)_n\text{-}SO_3M \quad (1)$$

wherein R represents an aliphatic hydrocarbon group having 6 to 18 carbon atoms, an alkylphenyl group having 7 to 18 carbon atoms or a phenyl group, n represents an integer of 1 to 3, and M represents an ammonium, an alkanolamine, an alkali metal or an alkaline earth metal, and $$CH_3\text{-}(CH_2)_m\underset{\underset{OH}{|}}{CH}\text{-}CH_2\text{-}SO_3M \quad (2)$$

wherein m represents an integer of 6 to 15, and M represents an ammonium, an alkanolamine, an alkali metal or an alkaline earth metal.

According to the invention, fiber articles are uniformly dyed with use of a dyeing auxiliary composition which comprises an anionic surfactant of the alpha-hydroxysulfonic acid type and an organic polybasic polymer and has a pH of 9 or higher. The invention provides the composition.

The composition may further comprise an aqueous medium and a pH adjuster.

It is preferable that the composition comprises 5 to 34 percent by weight of the anionic surfactant and 5 to 30 percent by weight of the organic polybasic polymer.

The anionic surfactant is preferred to have the above shown formula (1) or (2).

It is preferable that the organic polybasic polymer is of the polycarboxylic acid type or of the polysulfonic acid type.

The invention further provides a method for dyeing a fabric article of natural fibers, which comprises the steps of treating the fabric article in a dying bath with the composition as defined above and then adding to the bath a reactive dye, an inorganic salt and an alkali to effect the dyeing.

Examples of the anionic surfactants of an α-hydroxysulfonate type include sodium lauryl glyceryl ether sulfonate, sodium isooctyl glyceryl ether sulfonate and sodium α-hydroxyalkanesulfonates having 14 to 18 carbon atoms.

The polymeric compounds of an organic polybasic acid type usable in the present invention include compounds of a polycarboxylic or polysulfonic acid type. Examples of them include polyacrylic acid, polymethacrylic acid, carboxymethylcellulose, maleic acid/acrylic acid copolymer, styrene/maleic acid copolymer, polystyrenesulfonic acid, maleic acid/styrenesulfonic acid copolymer, olefin/ethylenically unsaturated dicarboxylic acid anhydride copolymers and salts of them.

The amounts of the anionic surfactant of an α-hydroxysulfonate type and the polymeric compound of an organic polybasic acid type in the leveling agent composition of the present invention are each in the range of 5 to 30 wt. %.

The leveling agent composition of the present invention may contain another anionic surfactant as a softener in the dye bath, hand improving or scouring agent in addition to the above-described anionic surfactant of an α-hydroxysulfonate type and polymeric compound of an organic polybasic acid type. Examples of the anionic surfactants usable for this purpose include fatty acid salts, polyoxyethylene alkyl ether sulfate salts, alkylbenzenesulfonates and N-acylalkylsulfoacetates.

The leveling agent composition for reactive dyes according to the present invention is usable in combination with an ordinarily used, commercially available penetrant in the same bath.

The surfactant in the leveling agent composition for reactive dyes according to the present invention can be selected suitably depending on the kind of the fibers and the kinds of the reactive dyes to be combined.

The pH of the leveling agent composition of the present invention must be 9 or higher. By using the leveling agent composition of the present invention, the initial pH of the dye bath (the pH of the dye bath before the addition of an alkali) can be kept at 8 to 10 in order to facilitate a homogeneous reaction of the fiber surface with the reactive dye.

When the leveling agent composition of the present invention is used for dyeing, the amount thereof is usually 1 to 3 g/l and the dyeing temperature must be suitably selected depending on the combination of the reactive dyes in the range of 40° to 80° C. In this case, the dyeing can be conducted at a constant temperature. Necessary amounts of the inorganic salt and the alkali in the dyeing can be added to the dye bath at once.

The dyeing process will now be described in more detail Water and fibers are placed in a dye bath to thoroughly wet the fibers The leveling agent composition of the present invention is added thereto to thoroughly penetrate it into the fibers or to adsorb it thereon. The dye, then the inorganic salt and finally the alkali are added to the dye bath and the dyeing is conducted at a constant temperature selected suitably in the range of 40° to 80° C. for a given time to obtain level dyed fibers When the leveling agent composition of the present invention is used for dyeing, sufficiently level dyeing can be attained by the above-described dyeing process irrespective of the kind of the dyeing machine used such as an ordinary wince dyeing machine, a reflux wince dyeing machine or a jet dyeing machine. When a jet dyeing machine or a reflux wince dyeing machine is to be used, however, a suitable amount of an antifoaming agent is needed.

When the leveling agent composition of the present invention is used in a dyeing step, the following defects of the conventional processes can be remarkably overcome.

(1) Level dyed fibers can be obtained with an excellent repeatability.

(2) The dyeing steps can be shortened, since the addition of the alkali or inorganic salt in portions is unnecessary. Therefore, the dyeing steps can be rationalized to reduce the cost remarkably.

(3) The dyeing and scouring can be conducted at the same time in the same bath. Even fibrous materials which have been pre-scoured only insufficiently can be level dyed.

(4) Level dyed fibers can be obtained by conducting the dyeing at a constant temperature throughout the dyeing steps, though the dyeing temperature varies depending on the combination of the reactive dyes.

As described above, not only the level dyed fibers can be obtained but also the dyeing steps can be remarkably rationalized by using the leveling agent composition of the present invention. No leveling agents for reactive dyes capable of exhibiting such comprehensive effects on the dyeing have been proposed heretofore.

EXAMPLES

The following Examples will further illustrate the present invention, which by no means limit the invention. Examples 1 to 18 and Comparative Examples 1 to 18

(1) Preparation of leveling agent

The leveling agent compositions of the present invention comprising the components shown in Table 1 were prepared.

TABLE 1

| | Leveling agent composition (%) | | | | | |
|---|---|---|---|---|---|---|
| | A | B | C | D | E | F |
| Sodium lauryl glyceryl ether sulfonate | 10 | | 10 | | | |
| Sodium isooctyl glyceryl ether sulfonate | | 10 | | | 10 | |
| Sodium α-hydroxyalkanesulfonate (having 14 to 18 carbon atoms) | | | | 10 | | 10 |
| Na salt of styrene/maleic acid copolymer | 15 | | | 15 | 15 | |
| Na salt of polyacrylic acid | | 10 | 10 | | | |
| Sodium polystyrenesulfonate | | 15 | | | | 10 |
| Sodium N-laurylalanine | 10 | | 10 | | | 10 |
| Sodium L-dodecylbenzenesulfonate | | | | 10 | | |
| Sodium POE(3) lauryl ether acetate | | | | | 10 | |
| Alkali | amount sufficient for giving a pH of 9 or higher | | | | | |
| Compatibilizer (water etc.) | amount sufficient for making up to 100% | | | | | |

(2) Dyeing tests by constant temperature process and the results

A folded test cloth having a size of 100×300 mm (about 5 g) was placed in a 500 ml Erlenmeyer flask and 75 ml of ion-exchanged water was added thereto. The flask was shaken at a constant speed (100 rpm) in the water bath by the following constant temperature process to dye the cloth.

The results are shown in Tables 2 and 3.

<Constant temperature process>

| | 10 min. | 30 min. | 90 min. |
|---|---|---|---|
| 50° C. | 2 g/l of leveling agent<br>1 to 3% of dye (OWF) | 20 g/l of Glauber's salt | 15 g/l of soda ash |

TABLE 2

| | Kind of dyes | Kind of fibers | Composition A | Results |
|---|---|---|---|---|
| Comp. Ex. 1 | Levafix Blue E-RN | mercerized cotton | none | unlevel |
| Ex. 1 | | | added | level |
| Comp. Ex. 2 | Remazol Brill Blue R-KN | " | none | unlevel |

TABLE 2-continued

| | Kind of dyes | Kind of fibers | Composition A | Results |
|---|---|---|---|---|
| Ex. 2 | | | added | level |
| Comp. Ex. 3 | Cibacron Red FB | " | none | unlevel |
| Ex. 3 | | | added | level |
| Comp. Ex. 4 | Levafix Yellow E-2RN | " | none | unlevel |
| Ex. 4 | Levafix Brown E-RN<br>Levafix Blue E-RN | | added | level |
| Comp. Ex. 5 | Levarix Turq Blue E-BA | prebleached cotton | none | unlevel |
| Ex. 5 | Levafix Brill Yellow E-GA | | added | level |

TABLE 3

| | Kind of dyes | Kind of fibers | Composition D | Results |
|---|---|---|---|---|
| Comp. Ex. 6 | Levafix Blue E-RN | mercerized cotton | none | unlevel |
| Ex. 6 | | | added | level |
| Comp. Ex. 7 | Remazol Brill Blue R-KN | " | none | unlevel |
| Ex. 7 | | | added | level |
| Comp. Ex. 8 | Cibacron Red FB | " | none | unlevel |
| Ex. 8 | | | added | level |
| Comp. Ex. 9 | Levafix Yellow E-2RN | " | none | unlevel |
| Ex. 9 | Levafix Brown E-RN<br>Levafix Blue E-RN | | added | level |
| Comp. Ex. 10 | Levafix Turq Blue E-BA | prebleached cotton | none | unlevel |
| Ex. 10 | Levafix Brill Yellow E-GA | | added | level |

The results obtained by using compositions A and D shown in Table 1 are shown in Tables 2 and 3. The results obtained by using other compositions were similar to them.

(3) Dyeing test by temperature elevation process and the results

A folded test cloth having a size of 100×300 mm (about 5 g) was placed in a 500 ml Erlenmeyer flask and 75 ml of ion-exchanged water was added thereto. The flask was shaken at a constant speed (100 rpm) in the water bath by the following temperature-elevation process to dye the cloth.

The dyeing results are shown in Tables 4 and 5.

<Temperature elevation process>

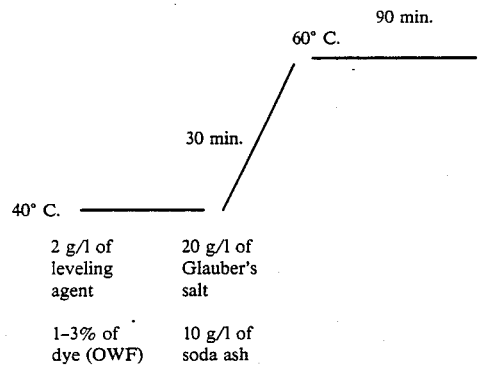

TABLE 4

| | Kind of dyes | Kind of fibers | Composition A | Results |
|---|---|---|---|---|
| Comp. Ex. 11 | Levafix Royal Blue E-FR | mercerized cotton | none | unlevel |
| Ex. 11 | | | added | level |
| Comp. Ex. 12 | Reactive Blue ZE-GN | hemp | none | unlevel |
| Ex. 12 | | | added | level |
| Comp. Ex. 13 | Sumifix Supra Navy Blue 2GF | cotton/hemp | none | unlevel |
| Ex. 13 | | blended fiber | added | level |
| Comp. Ex. 14 | Remazol Black B | prebleached cotton | none | unlevel |
| Ex. 14 | | | added | level |

TABLE 5

| | Kind of dyes | Kind of fibers | Composition C | Results |
|---|---|---|---|---|
| Comp. Ex. 15 | Levafix Royal Blue E-FR | mercerized cotton | none | unlevel |
| Ex. 15 | | | added | level |
| Comp. Ex. 16 | Reactive Blue ZE-GN | hemp | none | unlevel |
| Ex. 16 | | | added | level |
| Comp. Ex. 17 | Sumifix Supra Navy Blue 2GF | cotton/hemp | none | unlevel |
| Ex. 17 | | blended fiber | added | level |
| Comp. Ex. 18 | Remazol Black B | prebleached cotton | none | unlevel |
| Ex. 18 | | | added | level |

The results obtained by using composition E or C shown in Table 1 are shown in Tables 4 and 5. The results obtained by using other compositions were similar to them.

We claim:

1. A dyeing auxiliary composition, comprising:

at least one anionic surfactant selected from the group consisting of anionic surfactants having the formula $$R\text{-}(O\text{-}CH_2\text{-}\underset{\underset{OH}{|}}{CH}\text{-}CH_2)_n\text{-}SO_3M$$

and anionic surfactants having the formula $$CH_3\text{-}CH_2)_mCH\text{-}CH_2\text{-}\ \text{-}SO_3M$$

wherein R is an aliphatic hydrocarbon group having 6 to 18 carbon atoms, alkylphenyl having 7 to 18 carbon atoms or phenyl, n is an integer of 1 to 3, m is an integer of 6 to 15, and M is ammonium, alkanolamine, alkali metal or alkaline earth metal, and an organic polybasic polymer selected from the group consisting of polyacrylic acid, polymethacrylic acid, carboxymethylcellulose, maleic acid/acrylic acid copolymer, styrene/maleic acid copolymer, polystyrenesulfonic acid, maleic acid/styrenesulfonic acid copolymer, olefin/ethylenically dicarboxylic acid anhydride copolymers and salts thereof.

2. An aqueous solution of the dyeing auxiliary composition as claimed in claim 1.

3. An aqueous solution as claimed in claim 2 and including an alkali compound for adjusting said solution to a pH of 9 or higher.

4. An aqueous solution as claimed in claim 2 which comprises from 5 to 30 percent by weight of said anionic surfactant, and from 5 to 30 percent by weight of said organic polybasic polymer.

5. An aqueous solution as claimed in claim 3 which comprises from 5 to 30 percent by weight of said anionic surfactant, and from 5 to 30 percent by weight of said organic polybasic polymer.

6. A composition as claimed in claim 1 in which said anionic surfactant is selected from the group consisting of sodium lauryl·glyceryl ether sulfonate, sodium isooctyl glyceryl ether sulfonate and sodium--hydroxyalkanesulfonates having 14 to 18 carbon atoms.

7. A method for dyeing a fabric article comprised of wool, hemp, cotton or blends, thereof, which are dyeable by a reactive dye, which comprises the steps of treating the fabric article in a dyeing bath with the composition as defined in claim 9 and then adding to the bath a reactive dye, an inorganic salt and an alkali to effect the dyeing.

8. A method for dyeing a fabric article comprised of wool, hemp, cotton or blends thereof, which are dyeable by a reactive dye, which comprises the steps of treating the fabric article in a dyeing bath with the composition as defined in claim 11 and then adding to the bath a reactive dye, an inorganic salt and an alkali to effect the dyeing.

* * * * *

UNITED STATES PATENT AND TRADEMARK OFFICE

CERTIFICATE OF CORRECTION

PATENT NO. : 4,976,743

DATED : December 11, 1990

INVENTOR(S) : Noriaki OHBA et al

It is certified that error appears in the above-identified patent and that said Letters Patent is hereby corrected as shown below:

Column 7, lines 11-14; change the formula to read as follows:

--- $CH_3-(-CH_2-)_m-\underset{\underset{OH}{|}}{CH}-CH_2-SO_3M$ ---

Column 8, line 15; change "sodium--" to ---sodium-α- ---.

Column 8, line 22; change "9" to ---1---.

Column 8, line 29; change "11" to ---3---.

Signed and Sealed this

Eighth Day of September, 1992

*Attest:*

DOUGLAS B. COMER

*Attesting Officer*

*Acting Commissioner of Patents and Trademarks*